United States Patent [19]

Kiyota

[11] Patent Number: 4,867,943

[45] Date of Patent: Sep. 19, 1989

[54] STARTING MATERIAL FOR INJECTION MOLDING OF METAL POWDER AND METHOD OF PRODUCING SINTERED PARTS

[75] Inventor: Yoshisato Kiyota, Chiba, Japan

[73] Assignee: Kawasaki Steel Corporation, Hyogo, Japan

[21] Appl. No.: 282,489

[22] Filed: Dec. 12, 1988

[30] Foreign Application Priority Data

Dec. 14, 1987 [JP] Japan ..... 62-314271

[51] Int. Cl.[4] ..... B22F 1/00

[52] U.S. Cl. ..... 419/23; 419/36; 419/37; 419/54; 419/55; 419/57

[58] Field of Search ..... 419/23, 36, 37, 57, 419/54, 55

[56] References Cited

U.S. PATENT DOCUMENTS

| | | | |
|---|---|---|---|
| 4,404,166 | 9/1983 | Wiech | 419/36 |
| 4,445,936 | 5/1984 | Wiech | 419/36 |
| 4,602,953 | 7/1986 | Wiech | 419/37 |
| 4,661,315 | 4/1987 | Wiech | 419/36 |

*Primary Examiner*—Stephen J. Lechert, Jr.
*Attorney, Agent, or Firm*—Oliff & Berridge

[57] ABSTRACT

A starting material for injection molding of a metal powder including from 38 to 46% by volume of an organic binder and the balance of spherical iron powder with an average particle size from 2 to 6.5 μm and having high density sinterability at low sintering temperature, and a method of producing a sintered parts by conducting injection molding, debinding and sintering using the above-mentioned starting material in a non-oxidizing atmosphere at a temperature lower than the $A_3$ transformation point.

3 Claims, 4 Drawing Sheets

STARTING MATERIAL FOR INJECTION MOLDING OF METAL POWDER AND METHOD OF PRODUCING SINTERED PARTS

BACKGROUND OF THE INVENTION

1. Field of the Invention

The present invention concerns a starting material for injection molding of metal powder, as well as a method of producing sintered parts using such starting material.

2. Description of the Prior Art

Powder metallurgy has been developed as a method of producing those parts having complicated shapes at reduced cost.

As compared with conventional methods using uni-axial pressing, the injection molding method has particularly advantageous features in that it is comparable with the former in view of the mass productivity and can produce those three dimensional structural products of thin-walled small parts that can not be produced by the uni-axial pressing.

In addition, since fine powders can be molded by the use of the injection molding, sintered parts at high density can be obtained. As a result, it is possible to improve mechanical properties, magnetic properties, corrosion resistance, etc.

The injection molding process for a metal powder comprises a kneading step of kneading the metal powder with an organic binder to obtain a starting material for injection molding of the metal powder, a step of applying injection molding to the starting material as in the case of plastic molding thereby obtaining a molded parts, a degreasing step of removing the binder from the molded parts by applying heat treatment, etc. to the molded parts and a step of sintering the debinded molded parts, which are conducted successively.

The process comprising such steps has been known in, for example, Japanese Patent Laid-Open Nos. Sho 57-16103 and Sho 59-229403.

In the above-mentioned technique, however, although the sintering temperature is as high as about 1150° C or above, it is not possible to stably obtain the density ratio of sintered parts (ratio of the apparent density to the theoretical density) of greater than 93%.

Further, none of the disclosed techniques is economically disadvantageous since high sintering temperature has to be applied.

Japanese Patent Laid-Open No. Sho 59-229403 discloses an injection molding method for a mixture comprising a metal powder with an average particle size of greater from 1 to 50 μm and from 35.8 to 60.7% by volume of a binder. However, the density ratio obtained for the powder when sintered at a sintering temperature of 1200° C. for 30 min is only from 82 to 93%.

In view of such situations, it has been demanded for obtaining a starting material for injection molding of a metal powder capable of stably obtaining the density ratio of greater than 93% as well as for the method of producing a sintering product therefrom.

SUMMARY OF THE INVENTION

The object of the present invention is to overcome the foregoing problems in the prior art and obtain a starting material for injection molding of a metal powder capable of stably obtaining an iron powder sintered parts having a density ratio of greater than 93 by means of low temperature sintering.

Another object of the present invention is to provide a method of producing a sintered parts as described above.

The present inventors have made detailed experiments on the effect of the amount of the organic binder, the average particle size of the spherical iron powder and the sintering temperature on the injection moldability and the density ratio of the sintered parts and, as a result, have accomplished the present invention.

The present invention provides a starting material for injection molding of a metal powder having high density sinterability at low sintering temperature, comprising from 38 to 46% by volume of an organic binder added and an iron powder with a spherical average particle size of from 2 to 6.5 μm. Further, the present invention also provides a method of obtaining a sintered parts from the above-mentioned starting material by means of injection molding, wherein the sintering is conducted in a reducing atmosphere at a temperature lower than $A_3$ transformation point.

Generally, the sintering process proceeds along with the diffusion of constituent atoms and comprises a first step in which powder particles are coagulated with each other and a second step in which densification occurs due to the decrease of the porosity. The extent that the sintering density can reach mainly depends on the second step. The densification proceeds further as the average porosity size at the completion of the first step is smaller, the diffusion rate of constituent atoms into the porosity is greater, the diffusion rate of the porosity to the outside of the sintered parts is greater and less porosity is left in the inside. For attaining the object of the present invention, that is, for obtaining high sintered density stably and even at a low sintering temperature, the above-mentioned principle has to be taken into considerations.

DESCRIPTION OF THE ACCOMPANYING DRAWINGS

DESCRIPTION OF PREFERRED EMBODIMENT

In the present invention, the addition amount of the organic binder has to be from 38 to 46% by volume. The necessary amount of the binder added to the injection molding product is represented by the minimum amount for the sum of the amount required for filling porosity in the powder packing product and a necessary amount for providing the powder with injection flowability. The addition amount of the organic binder gives an effect on the flowability of a mixture of the organic binder and the powder (hereinafter referred to as a compound) and the density of the injection molding product.

Figure 4:
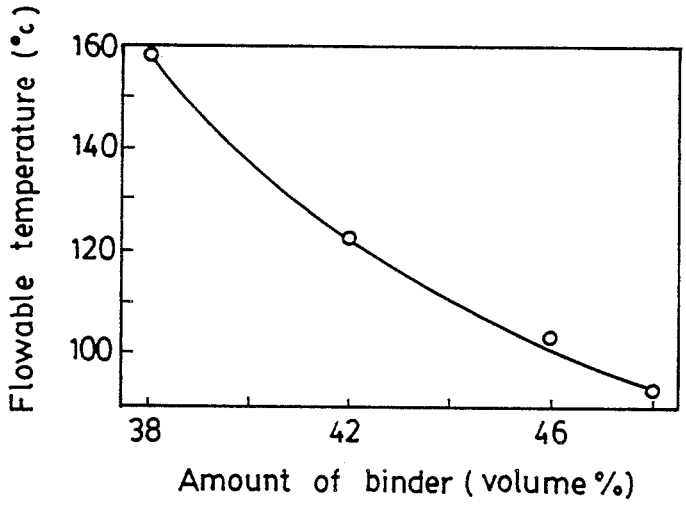
FIG. 4 is a graph illustrating a relationship between the amount of the binder and the flowable temperature.

As shown in FIG. 4, the flowable temperature becomes higher and the flowability is reduced as the amount of the binder is reduced and, if it is less than 38% by volume, injection molding is no longer possible. This is due to the fact that such a small amount of the binder can only fill the porosity in the powder packing product and is insufficient for providing the flowability. Accordingly, the lower limit for the amount of the binder is defined as 38% by volume. Further as apparent from FIG. 2, the sintered density is decreased along with the amount of the binder and, if it exceeds 46% by volume, the density ratio of greater than 93% can no longer be obtained. As apparent from FIG. 2, the sintered density is decreased along with the increase of the amount of the binder and, if it exceeds 46% by volume, the density ratio of greater than 93% is no longer obtainable. As the amount of the binder is increased, the ratio of the iron powder in the molded parts (iron powder packing ratio) is decreased, and the iron powder packing ratio in the injection molding product is maintained after the debinding step to give an effect on the average porosity size at the completion of the first step in the sintering process. That is, if the iron powder packing ratio in the injection molded parts is low, the average porosity size is increased at the end of the first step in the sintering process. As a result, a high sintered density can not be obtained. From the reason described above, the upper limit for the amount of the binder is defined as 46% by volume.

For the iron powder, it is necessary to use those spherical iron powders having a spherical average particle size of from 2 to 6.5 μm. By decreasing the particle size of the iron powder, porosity in the molded parts can be made smaller and it is possible to reduce the size of the average porosity present at the end of the first step in the sintering process. As a result, the second step of the sintering process can proceed rapidly to obtain a dense high density sintered part. As shown by symbols "o" in FIG. 1, if the average particle size exceeds 6.5 μm, sintered parts at high density can not be obtained and, accordingly, the upper limit for the average particle size of the iron powder is defined as 6.5 μm.

Figure 3:
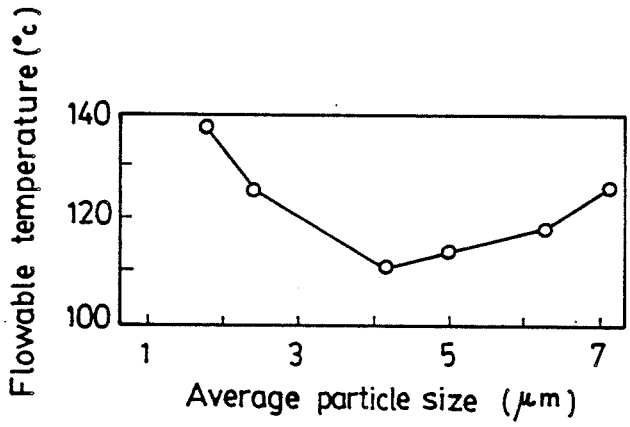
FIG. 3 is a graph illustrating a relationship between the average particle size of the iron powder and the flowable temperature.

Further as shown in FIG. 3, the flowability of the compound is reduced if the average particle size is too small since the flowable temperature is increased. Further, the cost for the iron powder is increased as the average particle size becomes smaller. Accordingly, those powders with the average particle size of less than 2 μm showing remarkable reduction in the flowability of the compound is not industrially preferred. In view of the above, the lower limit for the average particle size is defined as 2 μm.

The iron powder used herein are those of substantially spherical shape and with smooth surface. Excess recesses on the particles provide excess porosity for the sintered parts, whereas excess protrusions on the particles degrade the slip between the particles with each other. It is not appropriate to use such particles since excess addition of the binder is required in both of the cases as compared with the case of using smooth spherical particles. In addition, even if the particles have no remarkable irregularities, if their configuration are not substantially spherical but, for example, flaky or rod-like shape, they provide an anisotropic property to the injection molded parts and, as a result, dimensional shrinkage can not be forecast and no desired shapes can be obtained for the parts in the case of producing those of complicated shapes. Furthermore, those particles having angular shapes are neither appropriate since they require an excess amount of the binder like the case of the powders having protrusions.

Sintering has to be conducted in a non-oxidizing atmosphere and at a temperature of lower than the $A_3$ transformation point. If sintering is conducted at a temperature higher than the $A_3$ transformation point, crystal grains become coarser rapidly, in which the crystal grain boundaries are displaced from the porosity at the end of the first step in the sintering and the porosity is left in the crystal grain boundaries. As a result, it is no longer possible at the second step of the sintering for the diffusion of the porosity per se by way of the grain boundary to the outside of the sintered parts, or diffusion of atoms into the porosity by way of the grain boundary, by which the extent of densification attainable is reduced remarkably. This phenomenon is inherent to fine metal powders such as iron. If the sintering temperature is too lower than the $A_3$ transformation point, it is not practical since it takes a long time for the sintering. Accordingly, sintering is preferably conducted at 850° C.±50°C.

As has been described above, an iron powder sintering powder having a density ratio of greater than 93% can be obtained by selecting the iron powder and the amount of the binder and, further, the density ratio can further be increased by selecting the sintering conditions.

The binder usable in the present invention can include those known binders mainly composed of thermoplastic resins, waxes or mixtures thereof, to which a plasticizer, lubricant, debinding agent, etc. can be added as required.

As the thermoplastic resin, there can be selected acrylic, polyethylenic, polypropylenic or polystyrenic resin or a mixture of them.

As the wax, there can be selected and used one or more of natural waxes as represented by bee wax, Japanese wax and montan wax, as well as synthetic waxes as represented, for example, by low molecular weight polyethylene, microcrystalline wax and paraffin wax.

The plasticizer can be selected depending on the combination of the resin or the wax as the main ingredients and there can be used, for example, di-2-ethylhexylphthalate (DOP), di-ethylphthalate (DEP) and di-n-butylphthalate (DBP).

As the lubricant, there can be used higher fatty acids, fatty acid amides, fatty acids esters, etc. and depending on the case, the waxes can be used also as the lubricant.

Further, sublimating material such as camphor may be added as the debinding agent.

The iron powder can be selected from carbonyl iron powder, water-atomized iron powder, etc. and they can be used by pulverizing or classifying into a desired particle size and shape. The purity of the iron powder may be at such a level as other impurities excepting for carbon, oxygen and nitrogen that can be removed by heat treatment are substantially negligible, although it is dependent on the purity required for the final sintered parts. Those powders having from 97 to 99% of Fe can usually be used.

A batchwise or continuous type kneader can be used for the mixing and kneading of the iron powder and the binder. As the batchwise kneader, a pressurizing kneader or a Banbury mixer can be used. As the continuous kneader, a two-shaft extruder, etc. may be used. After kneading, pelletization is conducted by using a pelletizer or a pulverizer to obtain a starting molding material according to the present invention.

The molding material in the present invention is molded usually by using a plastic injection molding machine. If required, abrasion resistant treatment may be applied for those portions of the molding machine that are brought into contact with the starting material, thereby preventing the contaminating deposition or increasing the life of the molding machine.

The resultant molded part is applied with the debinding treatment in atmospheric air or in a neutral or reducing atmosphere.

Further, depending on the requirement, impurity element such as C, O and N can be reduced by heat treatment. The heat treatment is effectively conducted in an easily gas-diffusable step, that is, in a step where the sintering does not proceed completely. It is preferably conducted after the debinding and prior to the sintering in a hydrogen atmosphere, etc. under the dew point control at a temperature lower by about 50° C. than the sintering temperature.

In a case where the sintered part according to the present invention is used for soft magnetic materials, crystal grains can be grown to improve the soft magnetic properties by applying a heat treatment at a temperature higher than the sintering temperature after the sintering. At the same time, impurities such as C, O and N can be reduced to some extent.

According to the starting material and the method of using them in the present invention upon preparing iron powder sintered parts by using the injection molding process for metal powders, density ratio greater than 93% can be obtained stably and since the sintering temperature capable of obtaining such a density ratio can be lowered, the economical merit can be improved.

EXAMPLE

The present invention is to be described more detail referring to examples.

TABLE 1

| Iron powder * | Chemical composition (wt %) | | | Average particle size (μm) * |
|---|---|---|---|---|
| | Fe | C | O | |
| A† | 98.1 | 0.8 | 0.30 | 1.8 |
| B | 97.9 | 0.8 | 0.28 | 2.4 |
| C | 98.0 | 0.7 | 0.29 | 4.2 |
| D | 98.0 | 0.7 | 0.30 | 5.0 |
| E | 97.9 | 0.8 | 0.29 | 6.3 |
| F† | 98.0 | 0.7 | 0.28 | 7.1 |

Note
*: obtained by classifying carbonyl iron powder
*²: microtrack particle size analyzer
†: Comparative Example

Example-1

Starting materials for the present invention and comparative examples were prepared by kneading iron powders and acrylic resin binders shown in Table 1 by using a pressurizing kneader. After molding each of the molding materials by a plastic injection molding machine under the injection pressure of 1.5t/cm2 and at an injection temperature of 150° C., debinding was applied by elevating the temperature up to 475° C. at a rate of 8° C./h in argon and, further, the molded parts were sintered in hydrogen while being maintained at a selected temperature for 2 hours.

Figure 1:
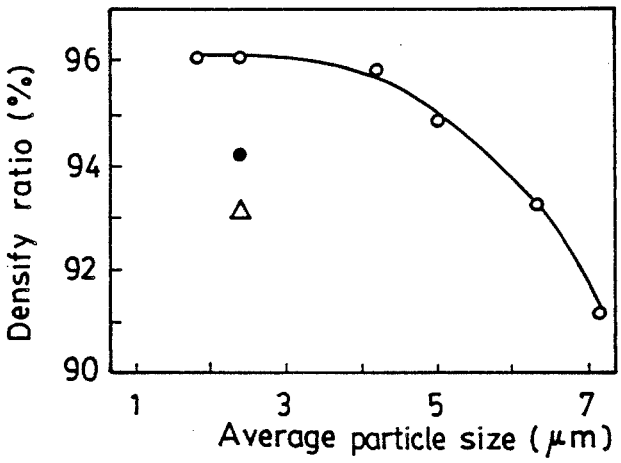
FIG. 1 is a graph illustrating a relationship between the average particle size of the iron powder and the density ratio in the sintered parts.
Figure 2:
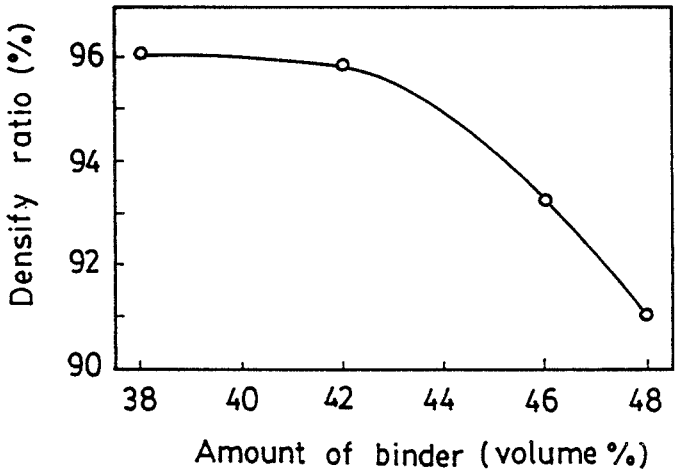
FIG. 2 is a graph illustrating a relationship between the amount of the binder and the density ratio of the sintered parts.

FIG. 1 and FIG. 2 show the relationships between the average particle size of the iron powder and the density ratio of the sintered body and between the amount of the binder and the density ratio of the sintered parts respectively. In FIG. 1, the binder was used by 40% by volume, in which sintering was conducted at 850° C. for "○" at 1150° C. for "Δ" and at 1300° C. "●" for respectively. FIG. 2 shows the result of sintering at 850° C. using the material B as the iron powder.

Density ratio of greater than 93% could be attained in any of the starting materials according to the present invention. On the other hand, the density ratio was low in any of the cases where the average particle size of the iron powder was greater than the upper limit in the present invention (7.1 μm) and where the amount of the binder was greater than the upper limit of the present invention (48 vol. %). Further, the density ratio of the sintered parts sintered at 1150° C. and 1300° C. were decreased as compared with the density ratio in a case where sintering was conducted at 850° C., e.g., lower than the $A_3$ transformation point. This phenomenon is caused by the fact that the densification is less obtainable since the crystal grains becomes coarser at higher temperature.

For evaluating the flowability of the molding material, a flow tester having a discharge port of 1 mm diameter and 1 mm length and put under the load of 10 kgf/cm$^2$ was used and the discharge amount was measured by the temperature elevation method. Generally, since it is said that the injection molding is possible if the discharge rate is greater than 0.01 cm$^3$/sec, the temperature at which the discharge rate reaches 0.01 cm$^3$/sec is defined as a flowable temperature. The relationship between the average particle size of the iron powder and the flowable temperature (with the binder amount of 40 vol. %) is shown in FIG. 3, while the relationship between the amount of the binder and the flowable temperature (iron powder B used) is shown in FIG. 4.

In a case where the average particle size of the iron powder is less than the lower limit in the present invention (1.8 μm), the flowability was decreased making it inappropriate for the injection molding. With such a region of the average particle size, even in a slight reduction in the average particle size will cause remarkable increase in the iron powder cost and no substantial increase in the density of the sintered parts can be expected (FIG. 1). Accordingly, only the particle size region as defined in the present invention is industrially appropriate in view of cost saving.

If the amount of the binder is less than the lower limit of the present invention it is impossible for the injection molding.

Example-2

Figure 5:
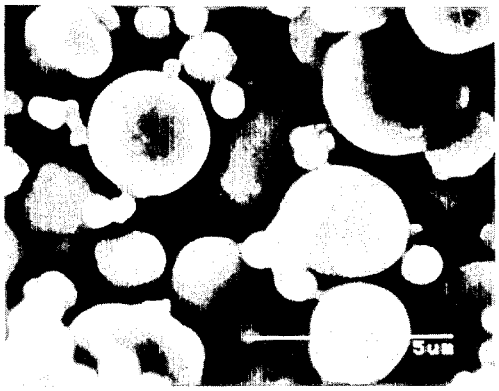
FIG. 5*a* –5*b* is a photograph showing the configuration of iron powder.
Figure 5:
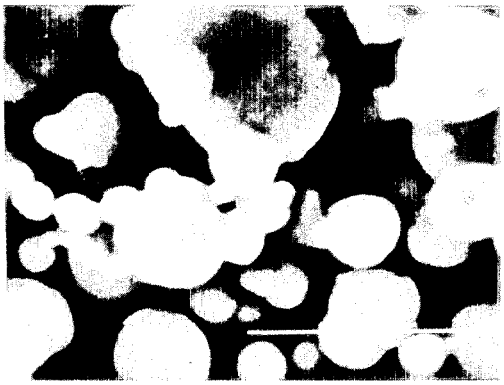
Figure 5:
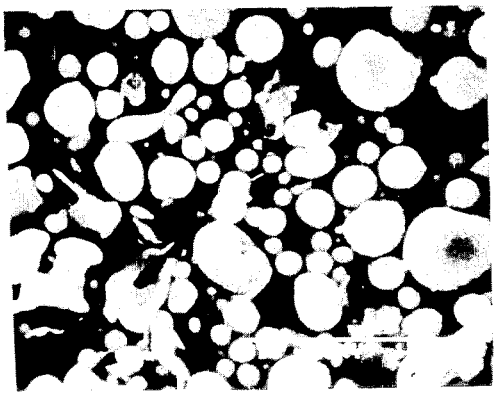
Figure 5:
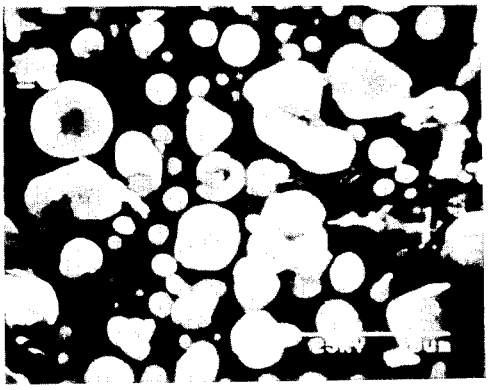

Iron powders of different production processes as shown in Table 2 were prepared. FIG. 5 shows scanning type electron microscopic photographs (SEM images) for respective iron powders. FIGS. 5 *a, b, c* and *d* represent, respectively, iron powders, G, H, I and J.

Sintered parts were produced by using the same binders and the steps as those in Example 1. The sintering was conducted in hydrogen at 850° C. for 2 hours.

The density ratio, etc. for the sintered parts are shown in Table 2. As apparent from the table, it can be seen that the sintered density ratio of greater than 93% can be obtained by the sintering at a lower temperature than usual according to the present invention and the method of use therein, also in the cases of the different production processes for the iron powders.

TABLE 2

| Iron powder | Chemical compostion (wt %) Fe | C | O | Average particle size (μm) | Binder amount (vol %) | Density ratio (%) |
|---|---|---|---|---|---|---|
| G* | 98.0 | 0.8 | 0.30 | 3.5 | 43 | 95.1 |
| H* | 99.7 | 0.03 | 0.17 | 4.3 | 41 | 94.1 |
| I** | 99.7 | 0.12 | 0.18 | 4.8 | 41 | 93.5 |
| J** | 99.6 | 0.20 | 0.25 | 3.8 | 43 | 95.0 |

* obtained by classifying carbonyl iron powder
** obtained by classifying high pressure-atomized iron powder

Example 3

Carbonyl iron powders of different particle sizes as shown in Table 3 were prepared. Chemical composition for these iron powders is also shown together. Sintered parts were produced into the same manner as in Example 1. After sintering under the condition of at 875° C. for 2 hours, they were cooled (Case I). In order to improve the magnetic properties of the sintered parts, sequential heat treatment at 1100° C. for 0.5 hour after sintering at 875° C. for 2 hours was conducted and they were cooled (Case II). Density ratio, chemical composition, average crystal grain size, and magnetic properties of the sintered parts are also shown together in Table 3.

It is apparent from Table 3 that the density ratio greater than 93% can be obtained in any of the sintered parts and the impurities such as C, O and N contained in the iron powders can also be reduced.

Furthermore, the sintered parts obtained under the condition of Case II have coarser crystal grain size and better magnetic properties than those of Case I.

TABLE 3

| Iron powder # | Property of iron powder: Chemical Composition (wt %) Fe | C | O | Average particle size (μm) | Binder amount (vol %) | Heat treatment case | Property of sintered parts: Density ratio (%) | Average crystal grain size (μm) | Chemical composition C | O | Magnetic properties B25 × 1000 G | μmax (−) |
|---|---|---|---|---|---|---|---|---|---|---|---|---|
| K | 97.7 | 0.8 | 0.3 | 2.1 | 46 | I | 95.1 | 15 | 0.04 | 0.02 | 13.7 | 1200 |
| | | | | | | II | 95.1 | 180 | 0.03 | 0.02 | 13.7 | 2000 |
| L | 97.9 | 0.7 | 0.3 | 4.3 | 42 | I | 95.0 | 20 | 0.03 | 0.02 | 13.7 | 1300 |
| | | | | | | II | 95.1 | 200 | 0.02 | 0.01 | 13.8 | 2400 |
| M | 97.9 | 0.7 | 0.3 | 6.0 | 38 | I | 95.1 | 25 | 0.03 | 0.02 | 13.7 | 1300 |
| | | | | | | II | 95.1 | 210 | 0.02 | 0.02 | 13.7 | 2600 |

Remarks:
B25: magnetic flux density at 25 Oe.
μmax: maximum magnetic permeability
#: obtained by classifying carboxyl iron powder

What is claimed is:

1. A method of producing a sintered parts by conducting injection molding, debinding and sintering by using starting material for injection molding of a metal powder, wherein a starting material comprising from 38 to 46% by volume of an organic binder and the balance of spherical iron powder with an average particle size from 2 to 6.5 μm is used and sintering is conducted in a non-oxidizing atmosphere at a temperature lower than the $A_3$ transformation point.

2. The method as defined in claim 1, wherein impurities such as C, O and N are reduced after the debinding and prior to the sintering at a temperature lower by about 50° C. than the sintering temperature.

3. The method as defined in claim 1, wherein sequential heat treatment at the temperature higher than the $A_3$ transformation point is conducted after the sintering whereby improving magnetic properties of the sintering parts.

* * * * *